US007243449B2

(12) United States Patent
Wichmann

(10) Patent No.: US 7,243,449 B2
(45) Date of Patent: Jul. 17, 2007

(54) CUBICLE TOP NAMETAG DISPLAY UNIT

(76) Inventor: John M. Wichmann, 2950 Saddlebrook Glen Dr., Cumming, GA (US) 30041

( * ) Notice: Subject to any disclaimer, the term of this patent is extended or adjusted under 35 U.S.C. 154(b) by 273 days.

(21) Appl. No.: 10/657,036

(22) Filed: Sep. 8, 2003

(65) Prior Publication Data

US 2005/0050783 A1 Mar. 10, 2005

(51) Int. Cl.
*A47G 1/17* (2006.01)
*G09F 15/00* (2006.01)

(52) U.S. Cl. ..... 40/606.01; 40/611.01

(58) Field of Classification Search ..... 248/231.41, 248/231.61, 234.71, 228.3, 229.12, 229.22; 40/604

See application file for complete search history.

(56) References Cited

U.S. PATENT DOCUMENTS 2,530,478 A * 11/1950 Parent ..... 248/103
2,551,157 A * 5/1951 Price ..... 248/488
4,301,767 A * 11/1981 Willinger et al. ..... 119/245
4,704,813 A 11/1987 Fast
5,167,391 A 12/1992 Simpson
5,388,359 A * 2/1995 DeWitt ..... 40/607.14
5,480,116 A 1/1996 Callas
5,609,317 A * 3/1997 Glynn et al. ..... 248/206.5
5,618,141 A 4/1997 Field
5,701,695 A 12/1997 Current
5,822,918 A * 10/1998 Helfman et al. ..... 47/39
6,119,992 A 9/2000 Stuart
2005/0045785 A1 * 3/2005 Cohen ..... 248/214

* cited by examiner

*Primary Examiner*—Cassandra Davis
(74) *Attorney, Agent, or Firm*—Aurthur G. Yeager

(57) ABSTRACT

A sign display mountable over a top surface of a cubicle wall includes a sign holder having a frame and a depending post extending therefrom for carrying a sign. A clamp assembly has a pair of engaging members and an attachment for securing the engaging members together to abut respective opposed vertical surfaces of a cubicle wall and a horizontal wall portion with an upper and lower surface. One engaging member includes at least one hole and the other engaging member includes an elongate slot. A threaded bolt is positionable upwardly through the elongate slot and one hole for securing the engaging members together. Each engaging member is a bracket formed as an L-shaped member to abut against a vertical surface of a cubicle wall and a horizontal wall portion.

12 Claims, 7 Drawing Sheets

CUBICLE TOP NAMETAG DISPLAY UNIT

CROSS-REFERENCE TO RELATED APPLICATION

The present application is related to Provisional Application No. 60/316,694, entitled "CUBICLE TOP NAMETAG DISPLAY UNIT", filed Aug. 31, 2001 by the present applicant.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention pertains to sign holders and particularly to sign holders for work cubicle walls that are adjustable in height and direction and modular in construction.

2. Related Art

A wide variety of sign holders are known to the prior art. None of the devices are adaptable to the top surface of a cubicle wall and adjustable to a wide variety of wall widths. Devices for cubicle wall mounting should be adjustable in height and movable through 360° to a desired direction to be easily viewable.

BRIEF SUMMARY OF THE INVENTION

In one aspect of the present invention there is provided a sign display unit comprising a sign holder including a frame member, which includes means for carrying a sign, and mounting means for removably securing the sign holder above and to a top surface of a cubicle wall. Means for mounting the sign holder to the mounting means is provided for incremental movement of the sign holder through 360°. The mounting means includes bracket members and attachment means for securing the bracket members together to provide engagement with opposed vertical sides of a cubicle wall by the bracket members. One bracket member includes an elongate slot and another bracket member includes at least one hole positionable over the elongate slot, the attachment means including a fastener positionable through the at least one hole and the elongate slot for securing the bracket members together. Each bracket member is formed as an L-shaped member having a vertical wall portion with an outside surface and an inside surface located to abut against a vertical surface of a cubicle wall and a horizontal wall portion with an upper and lower surface. The vertical wall portions of each bracket member including a plurality of vertically disposed ribs extending laterally from respective inside surface of the vertical wall portion to engage a vertical surface of a cubicle wall. The horizontal wall portion of another bracket member includes at least one hole and two downwardly extending elongate spaced walls defining a channel, said horizontal wall portion of one bracket member includes the elongate slot, the horizontal wall portion of another bracket member sized in width to be located inside the channel of the one bracket. The lower surface of the horizontal wall portion of the one bracket member includes a plurality of elongate ribs extending downwardly therefrom for engaging a top surface of a cubicle wall.

The mounting means includes a post depending from the sign holder, the post having an upper portion connected to the sign holder and a lower portion, a pair of brackets mountable to a cubicle wall, and a fastener means for securing the brackets together and being engaged with the lower portion of the post for attaching the post to the brackets. One bracket includes an elongate slot and another bracket includes at least one hole positionable over one bracket and over the elongate slot, the fastener means including a base member having an upper portion with an upper cavity formed therein for mounting the lower portion of the post into the upper cavity, the lower portion of the base member having a threaded cavity therein, and bolt means positionable upwardly through the elongate slot and the at least one hole and into the threaded cavity of the base member for securing the brackets between the bolt and the base member for mounting the sign holder to the brackets. The means for mounting the sign holder also includes a plurality of spaced teeth on the surface of the lower portion of the post and the upper cavity of the base member having a plurality of spaced vertical cooperating grooves sized to accept the teeth on the lower portion of the post therein to secure the sign holder into one of a plurality of selectable positions with respect to a cubicle wall.

In another aspect of the present invention there is provided a sign display mountable over a top surface of a cubicle wall comprising a sign holder including a frame and a depending post extending therefrom for carrying a sign, a first and second bracket, each bracket being formed as an L-shaped member having a vertical wall portion with an outside surface and an inside surface located to abut against respective opposed vertical surfaces of a cubicle wall and a horizontal wall portion with an upper and lower surface. The horizontal portions of the first and second bracket are disposed in at least partially overlapping relation to nest opposed vertical surfaces of a cubicle wall therebetween, the post having a lower end portion and being supported by one horizontal wall portion. The horizontal wall portion of the first bracket including at least one hole and two downwardly extending elongate spaced walls defining a channel. The horizontal wall portion of the second bracket includes an elongate slot and the horizontal wall portion of the second bracket sized in width to be positionable inside the channel of the first bracket. The base member includes a lower portion having a threaded cavity therein, a bolt having a head and a threaded shank positionable upwardly through the elongate slot and the at least one hole and threadable into the cavity of the lower portion of the base member for securing the brackets together between the bolt and the base member. The post has a plurality of splines formed thereon and a base member has an upper portion having a cavity formed therein with a plurality of spaced splines sized and space to accept the splines on the post to interfit the post in the cavity thereby mounting said post to the base member. The horizontal wall portion of the bracket includes two downwardly elongate spaced walls defining a channel, the threaded bolt including a bolt head, the bolt head sized to fit inwardly of the channel to allow the spaced walls to rest against a top surface of a cubicle wall. The vertical wall portions of each bracket include a plurality of elongate ribs extending laterally from the respective inside surface of the respective wall portion to engage a vertical surface of a cubicle wall. The frame is generally rectangular in form and includes elongate upper and lower members and opposite side members and has an elongate generally rectangular interior space therein. The one opposite side member includes a vertically disposed slot communicating with the interior space to allow for the insertion of a sign into the interior space.

In a further aspect of the present invention, there is provided a sign display mountable over a top surface of a cubicle wall comprising a sign holder including a frame and a depending post extending therefrom for carrying a sign, a clamp assembly having a pair of engaging members and attachment means for securing the engaging members together to abut respective opposed vertical surfaces of a cubicle wall and a horizontal wall portion with an upper and lower surface. The engaging members are disposed in at least partially overlapping relation to nest opposed vertical surfaces of a cubicle wall therebetween, the post having a lower end portion and being supported by one engaging member. One engaging member includes at least one hole and two downwardly extending elongate spaced walls defining a channel, another engaging member including an elongate slot, a base member having an upper portion having a cavity therein sized to accept the post to mount the post onto the base member. The lower portion of the base includes a threaded cavity, a threaded bolt positionable upwardly through the elongate slot and the at least one hole and threadable into the threaded cavity of the base member for securing the engaging members together between the bolt and the base member.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
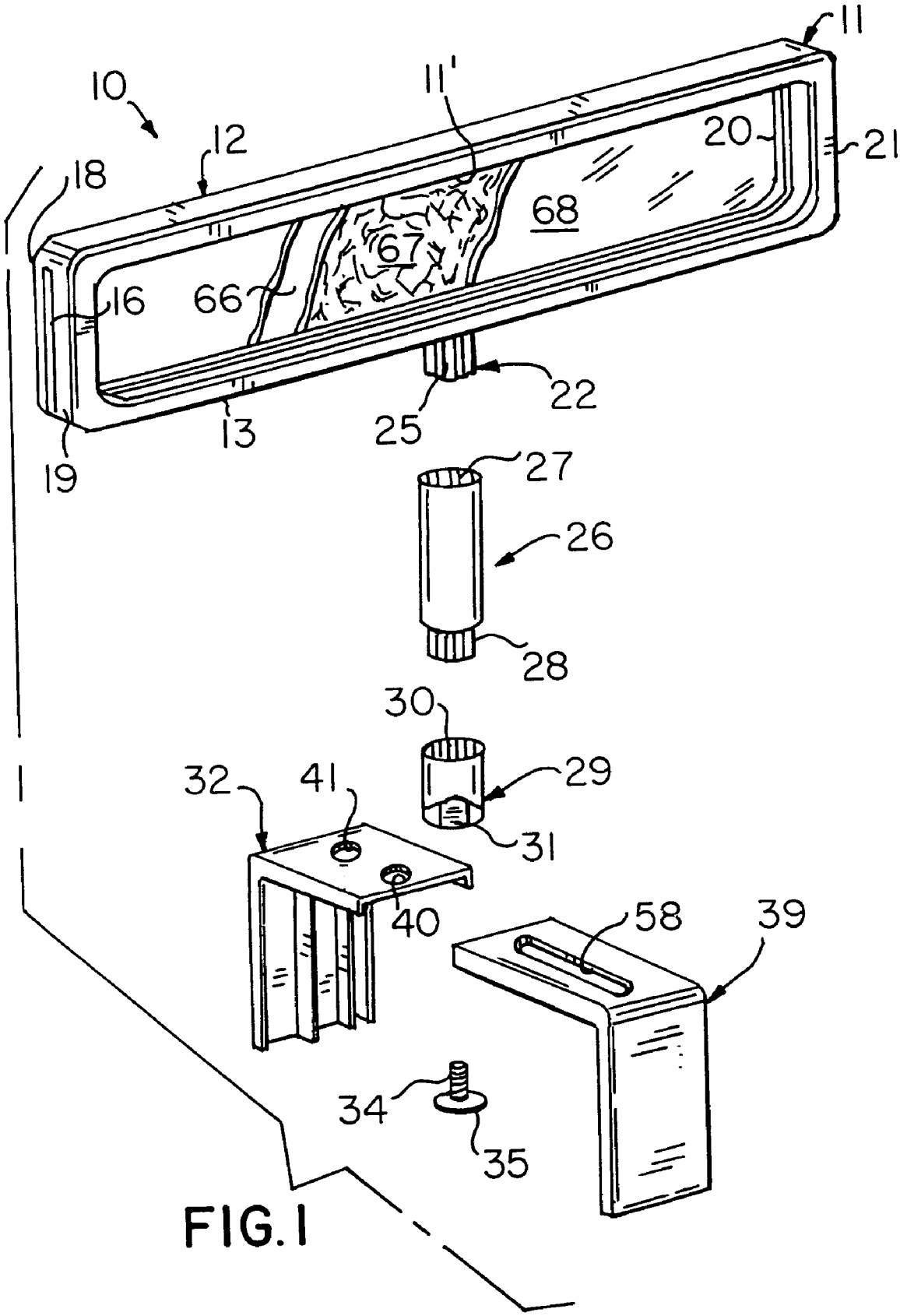
FIG. 1 is an exploded view of the complete assembly of the cubicle top nametag display unit in accord with the present invention.

An exploded view of the display unit is illustrated in FIG. 1 at numeral 10. The sign holder 11 is a rectangular frame with viewing area 11' molded of plastic in two parts and secured together with adhesive or other appropriate means as understood in the art. Rear section 12 has opposite ends 18 and 20 and front section 13 has opposite ends 19 and 21.

Figure 2:
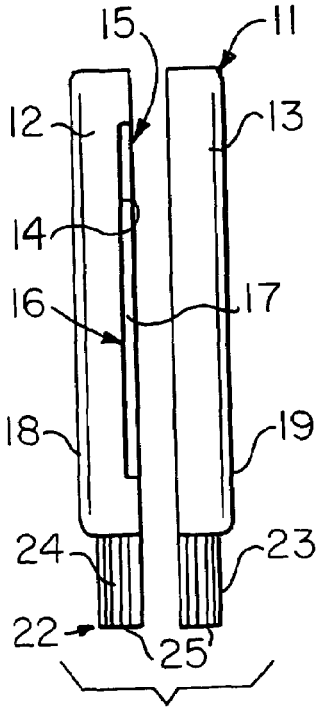
FIG. 2 is a side view of the two halves of the sign holder shown separated.

With reference to FIG. 2 a sign carrying channel 14 is formed in rear section 12 at left-hand end 18. When sections 12 and 13 are secured together a rectangular cavity or interior space 15 is formed for carrying a sign therein, which is inserted through cavity opening or slot 16. End wall 17 acts as a travel limit for an inserted sign.

Mounting post 22 is integral with sections 12 and 13 and is molded in two sections 23 and 24. The outer surface of post 22 is formed with vertically disposed teeth or splines 25.

Figure 3:
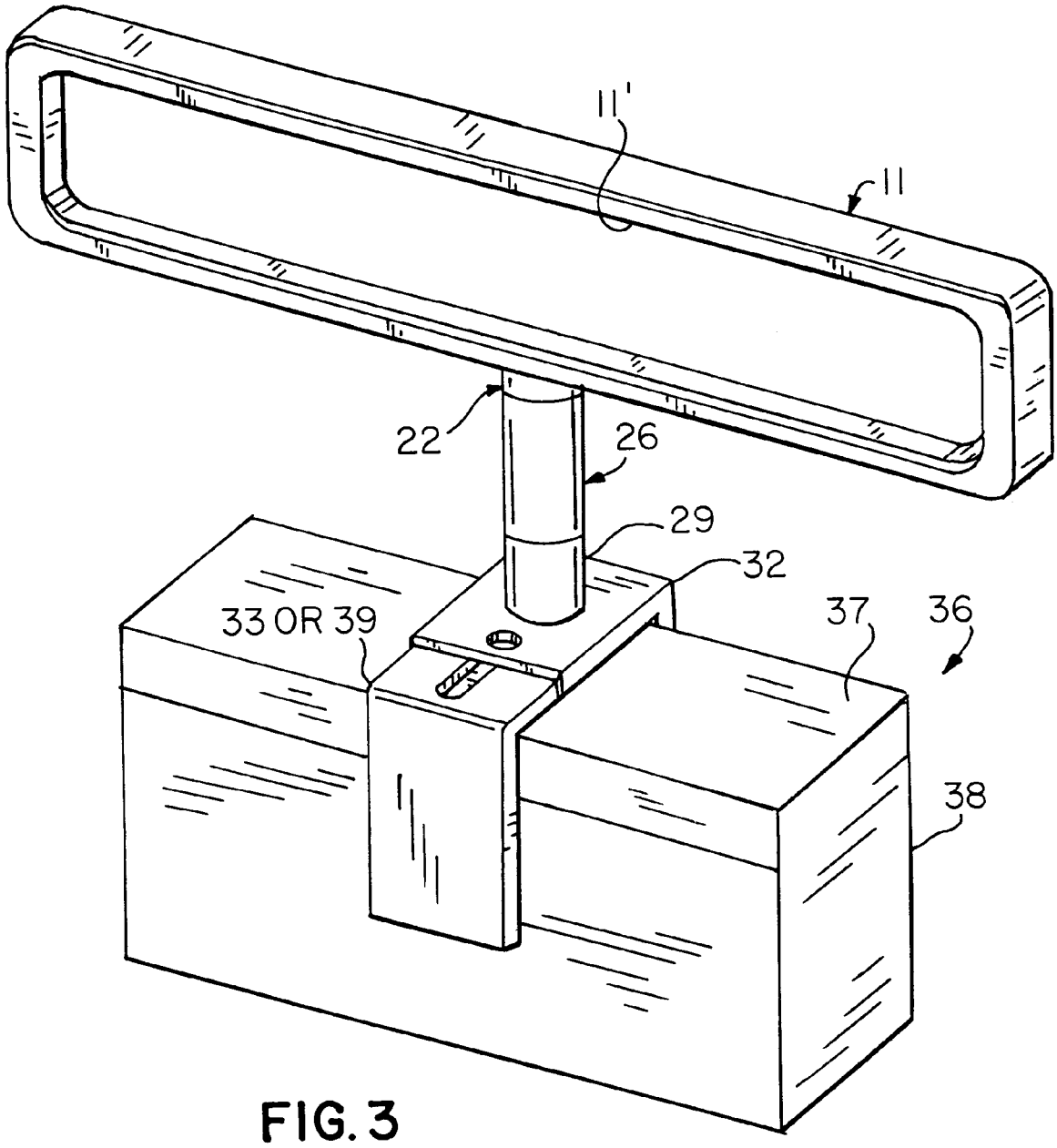
FIG. 3 is a perspective view of the unit of FIG. 1 shown mounted to the top of a cubicle wall.

With respect again to FIG. 1, post 22 fits within cavity 27 or 30 that includes vertical channels formed in mast 26 and is positionable in increment through 360°. A post portion 28 is integrally formed with mast 26 and is preferably identical to post 22. Mast base 29 has an upper-toothed cavity 30 preferably identical with cavity 27 and thereby allowing incremental movement of mast 26 through 360°. The lower portion of base 29 is shown partially broken away to illustrate a lower threaded cavity portion 31 formed to accept a standard hex bolt 34 having head 35. The unit 11 is mounted to a cubicle wall 36 via a clamp assembly consisting of L-shaped brackets 32, 33 (FIG. 5), and 39. Adjustment bracket 33 or 39 fits into base bracket 32. Hex bolt 34 is inserted from underneath upwardly through a selected hole 40, 41 and through slot 58, 50 at a selected location into mast base 29. Adjustment bracket 33 or 39 can be moved with respect to base bracket 32 to accommodate the thickness of a cubicle wall 36 having top surface 37 and main body 38 (FIG. 3).

Head 35 of hex bolt 34 is sized in thickness so that head 35 does not extend below the lower surface of the ribs 57 or 59 (FIGS. 5 and 6) of adjustment bracket 33 or 39. If head 35 were too thick, the unit 10 would not rest flat against the upper surface 37 of cubicle wall 36. In addition, the head 35 is sized to fit between and against depending ribs 57 or 59' to prevent rotation of the bolt 34 when in place.

Figure 4:
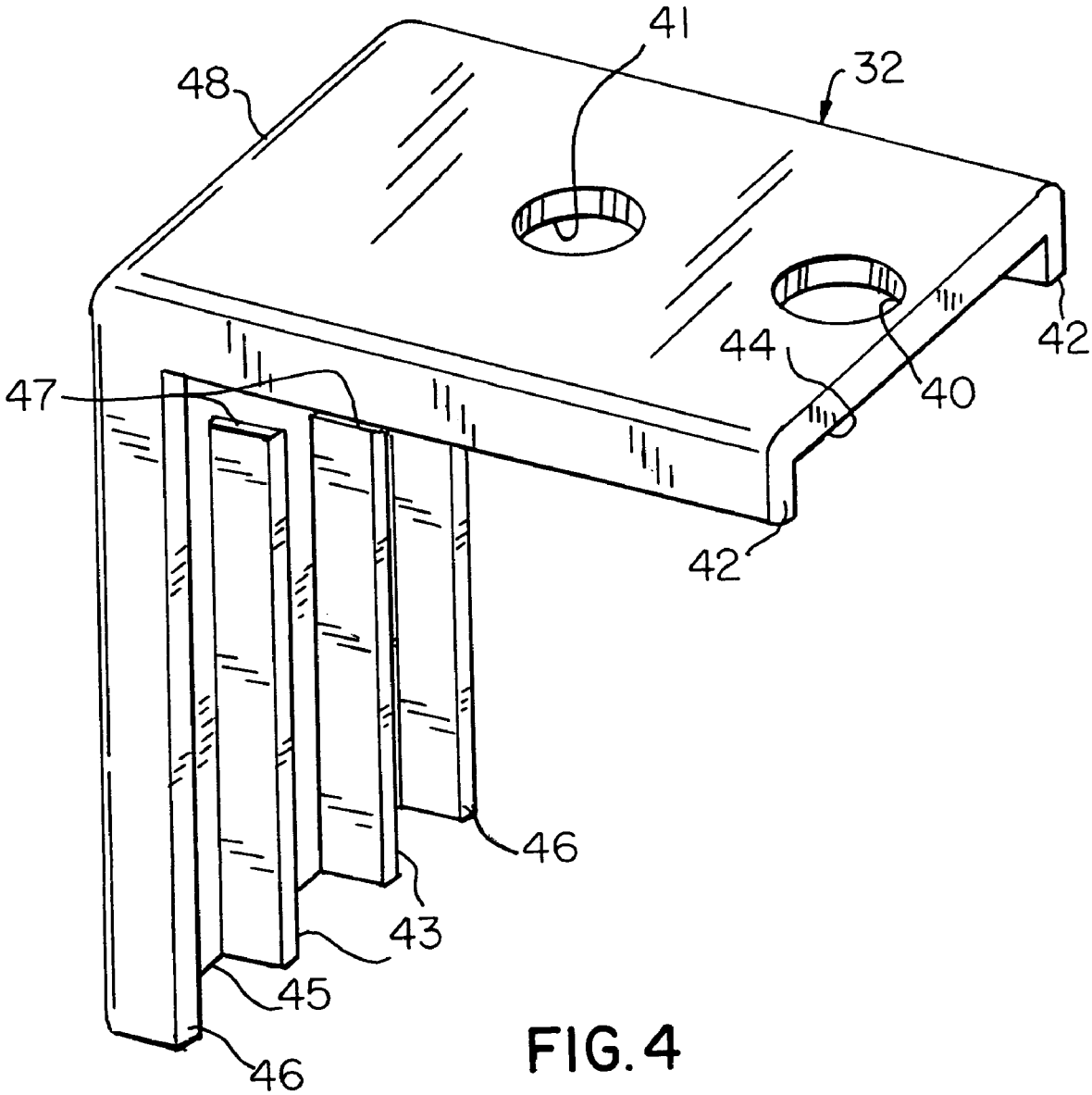
FIG. 4 is a perspective view of a base bracket in accord with the present invention.

FIG. 4 illustrates the base bracket 32. Walls 42 define a channel 44 at the lower portion of upper member 48. Vertical wall 45 includes outside ribs 46 and shorter inside ribs 43 that terminate at top portions 47 to accommodate the vertical thickness of the horizontal portion of the adjustment bracket 33 and 39 used as will be discussed hereinbelow.

Figure 5:
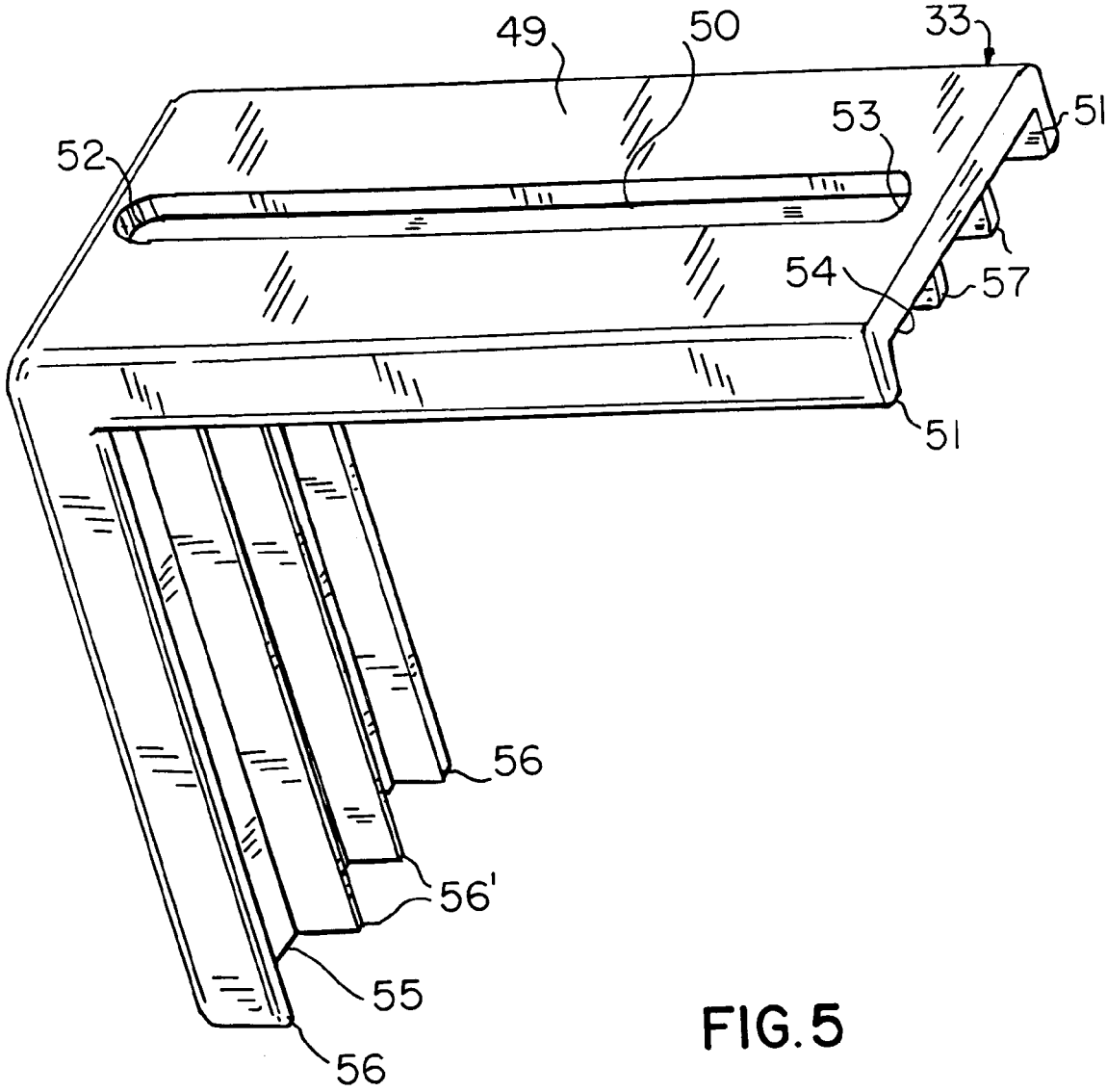
FIG. 5 is a perspective view of a long adjustment base bracket in accord with the present invention.

FIG. 5 illustrates a long adjustment bracket 33. Upper member 49 has an elongate slot 50 terminate at ends 52 and 53. Walls 51 define a channel 54, which includes a pair of elongate ribs 57 therein. Vertical wall 55 includes vertical outer walls 56 and a pair of vertical ribs 56'.

Figure 6:
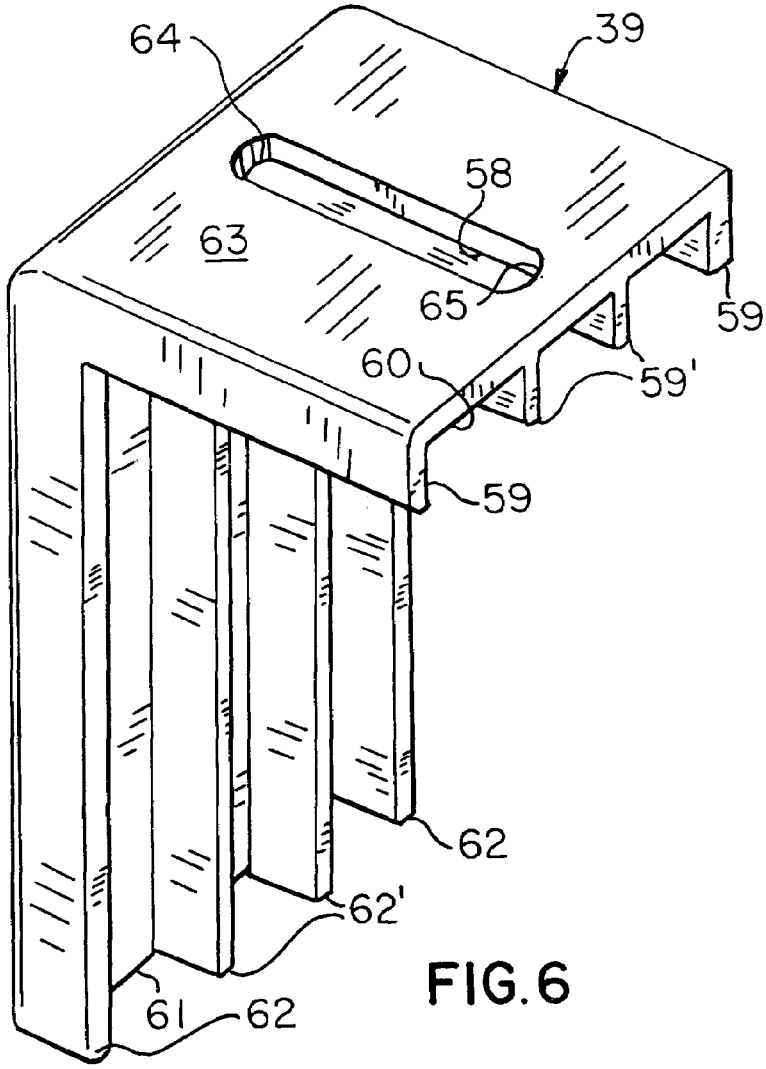
FIG. 6 is a perspective view of a short type of the adjustment base bracket shown in FIG. 5.

FIG. 6 illustrates a short adjustment bracket 39. Top horizontal member 63 includes walls 59 defining a channel 60 with ribs 59' sized to be identical with walls 59. An elongate adjustment slot 58 has ends 64 and 65. Vertical wall 61 has outward ribs 62 and interior ribs 62'. Bracket 39 functions exactly as does bracket 33.

Figure 7:
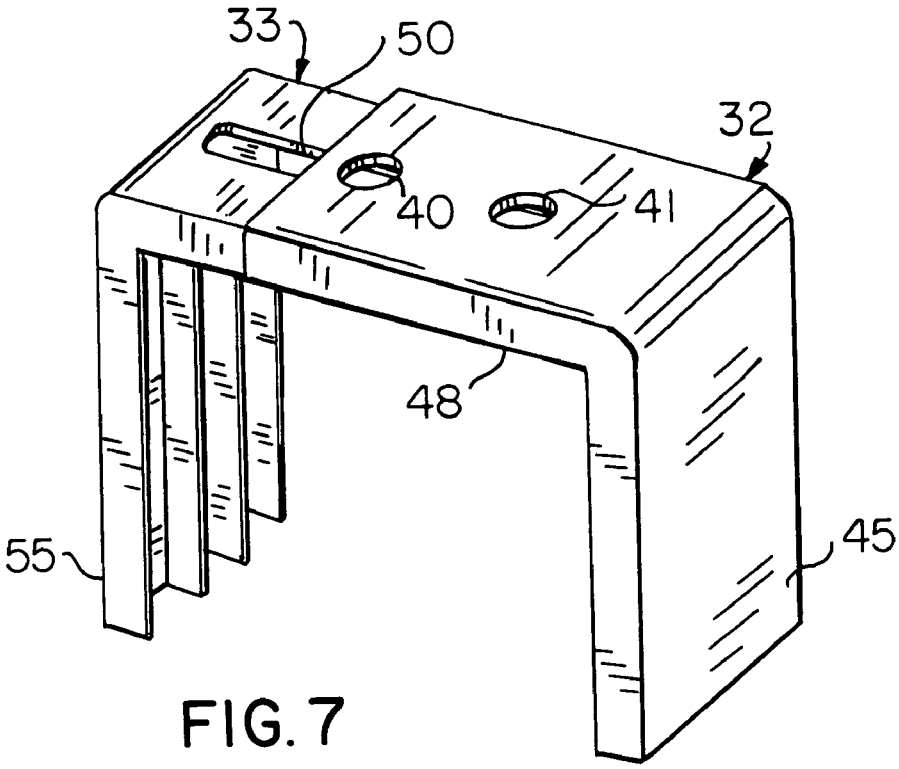
FIG. 7 is a perspective view of the long adjustment bracket of FIG. 6 and the base bracket of FIG. 4 at minimum extension.
Figure 8:
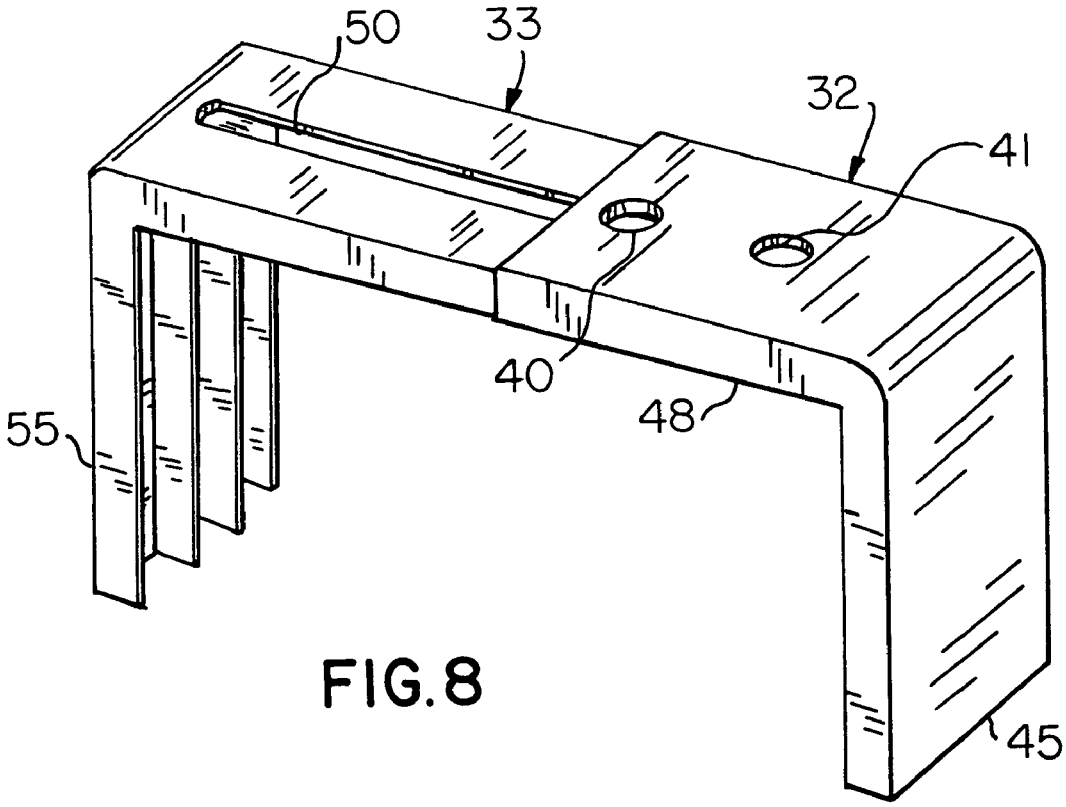
FIG. 8 is a perspective view of the brackets of FIG. 7 at maximum extension.

FIGS. 7 and 8 illustrate a long adjustment base 33 and a base bracket 32 in a minimal extension (FIG. 7) and at a maximum extension (FIG. 8).

Figure 9:
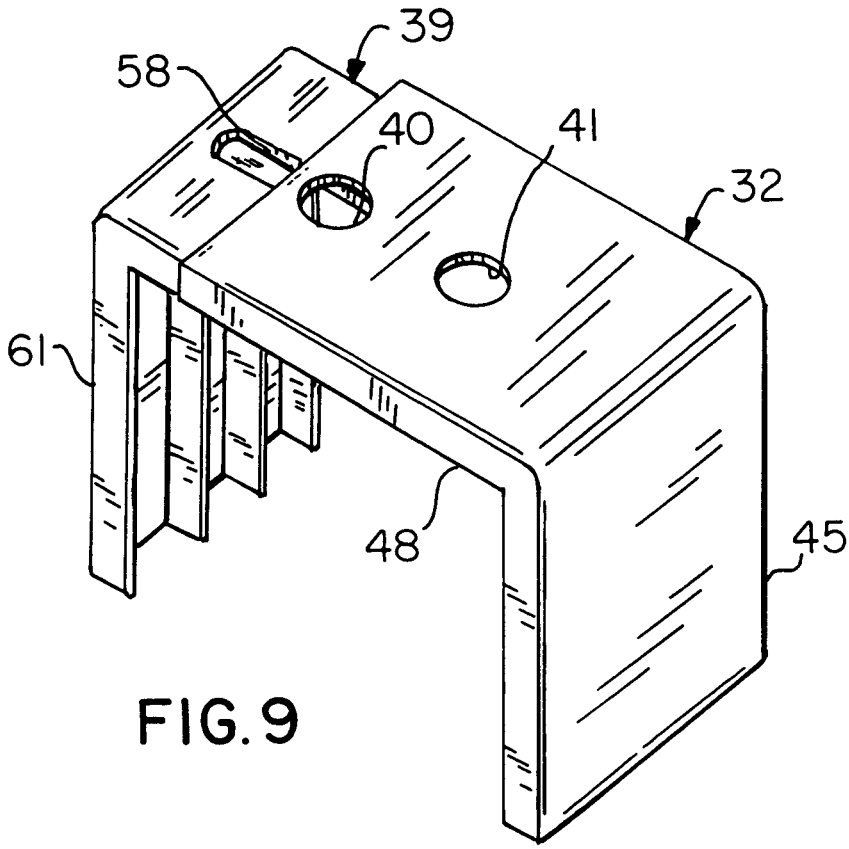
FIG. 9 is a perspective of the short bracket of FIG. 5 and the base bracket of FIG. 4 at maximum extension.
Figure 10:
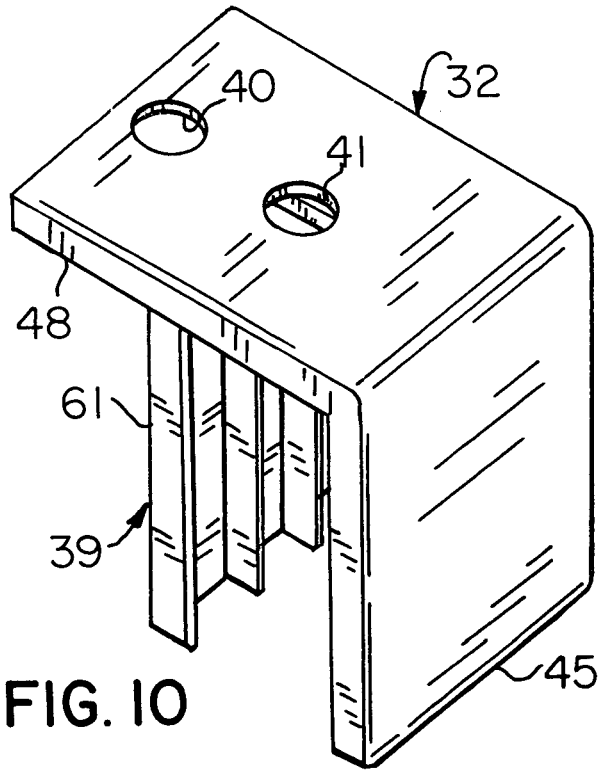
FIG. 10 is a perspective view of the brackets of FIG. 9 at minimum extension.

FIGS. 9 and 10 illustrate a short adjustment base 39 and a base bracket 32 in a maximum extension (FIG. 9) and at a minimum extension (FIG. 10).

The choice between bases 33 and 39 depends upon the width of a cubicle wall 36, which, as understood in the art, vary widely.

Furthermore, mast 26 may or may not be used to control the height of the sign holder 11 above the surface 37 of a wall as desired. As discussed hereinabove, the cavity 30 of base 29 is identical to cavity 27 in 26. Moreover, the length of mast 26 may be longer than illustrated.

The inserts 66, 67, and 68 illustrated in broken-away fashion in FIG. 1 may be of several different types. If, for example, transparent plastic signs are used for signs 66 and 68 and thereby expose the name in reverse on the other side an opaque insert 67 made of cardboard or the like can be used between them, if desired.

Finally, ribs 43 and 46 of bracket 32 and ribs 56' and 62' of brackets 33 and 39 respectively, extend in a manner to push inwardly against the vertical surfaces of wall 36 to firmly engage the wall 36.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A sign display unit comprising a sign holder including a frame member, said frame member including means for carrying a sign, and mounting means for removably securing said sign holder above and to a top surface of a cubicle wall, and means for mounting said sign holder to said mounting means to provide for incremental movement of said sign holder through 360°, said mounting means including bracket members and attachment means for securing said bracket members together to provide engagement with opposed vertical sides of a cubicle wall by said bracket members, each said bracket member is formed as an L-shaped member having a vertical wall portion with an outside surface and an inside surface located to abut against a vertical surface of a cubicle wall and a horizontal wall portion with an upper and lower surface, said vertical wall portions of each said bracket member including a plurality of vertically disposed ribs disposed perpendicular to respective said horizontal wall portion and extending laterally from respective said inside surface of said vertical wall portion to engage a vertical surface of a cubicle wall, said horizontal wall portion of said another bracket member includes said at least one hole and two downwardly extending elongate spaced walls defining a channel, said horizontal wall portion of said one bracket member includes said elongate slot, said horizontal wall portion of said another bracket member sized in width to be located inside said channel of said one bracket.

2. The unit as defined in claim 1 wherein said lower surface of said horizontal wall portion of said one bracket member includes a plurality of elongate ribs extending downwardly therefrom for engaging a top surface of a cubicle wall.

3. A sign display unit comprising a sign holder including a frame member, said frame member including means for carrying a sign, and mounting means for removably securing said sign holder above and to a top surface of a cubicle wall, and means for mounting said sign holder to said mounting means to provide for incremental movement of said sign holder through 360°, said mounting means includes a pair of L-shaped brackets each formed as a channel member having a pair of spaced parallel walls and attachment means for securing said brackets together to provide engagement with opposed planar vertical sides of a cubicle wall by said brackets, said mounting means including a post depending from said sign holder, said post having an upper portion connected to said sign holder and a lower portion, and a fastener means for securing said brackets together and being engaged with said lower portion of said post for attaching said post to said brackets, one said bracket includes an elongate slot and another said bracket includes at least one hole positionable over said one bracket and over said elongate slot, said fastener means including a base member having an upper portion with an upper cavity formed therein for mounting said lower portion of said post into said upper cavity, said lower portion of said base member having a threaded cavity therein, and bolt means positionable upwardly through said elongate slot and said at least one hole and into said threaded cavity of said base member for securing said brackets between said bolt and said base member for mounting said sign holder to said brackets.

4. The unit as defined in claim 3 wherein said means for mounting said sign holder includes a plurality of spaced teeth on the surface of said lower portion of said post and said upper cavity of said base member having a plurality of spaced vertical cooperating grooves sized to accept said teeth on said lower portion of said post therein to secure said sign holder into one of a plurality of selectable positions with respect to a cubicle wall.

5. A sign display mountable over a top surface of a cubicle wall comprising a sign holder including a frame and a depending post extending therefrom for carrying a sign, a first and second bracket, each said bracket being formed as an L-shaped member having a vertical wall portion with an outside planar vertical surface and an inside surface located to abut against respective opposed vertical surfaces of a cubicle wall and a horizontal wall portion with an upper and lower surface, a base member being removably mountable to one said horizontal wall portion of one said bracket said horizontal wall portions of said first and second bracket being disposed in at least partially overlapping relation to dispose said vertical wall portions of said L-shaped members to nest respectively against opposed vertical surfaces of a cubicle wall therebetween, said post having a lower end portion supported by said base member, said horizontal wall portion of said first bracket including at least one hole and two downwardly extending elongate spaced walls defining a channel, said horizontal wall portion of said second bracket including an elongate slot, said horizontal wall portion of said second bracket sized in width to be positionable inside said channel of said first bracket.

6. The display as defined in claim 5 wherein said base member includes a lower portion having a threaded cavity therein, a bolt having a head and a threaded shank positionable upwardly through said elongate slot and said at least one hole and threadable into said cavity of said lower portion of said base member for securing said brackets together between said bolt and said base member.

7. The display as defined in claim 6 wherein said post has a plurality of splines formed thereon, said base member having an upper portion having a cavity formed therein with a plurality of spaced splines sized and spaced to accept said splines on said post to interfit said post in said cavity thereby mounting said post to said base member.

8. The display as defined in claim 5 wherein said horizontal wall portion of said bracket includes two downwardly elongate spaced walls defining a channel, said threaded bolt including a bolt head, said bolt head sized to fit inwardly of said channel to allow said spaced walls to rest against a top surface of a cubicle wall.

9. The display as defined in claim 5 wherein said vertical wall portions of each said bracket includes a plurality of elongate ribs disposed perpendicular to said horizontal portion extending laterally from respective said inside surface of respective said wall portion to engage a vertical surface of a cubicle wall.

10. The display as defined in claim 5 wherein said frame is generally rectangular in form and includes elongate upper and lower members and opposite side members, said frame having an elongate generally rectangular interior space therein.

11. The display as defined in claim 10 wherein one said opposite side member includes a vertically disposed slot communicating with said interior space to allow for the insertion of a sign into said interior space.

12. A sign display mountable over a top surface of a cubicle wall comprising a sign holder including a frame and a depending post extending therefrom for carrying a sign, a clamp assembly having a pair of engaging members and attachment means for securing said engaging members together to abut respective opposed vertical surfaces of a cubicle wall and a horizontal wall portion with an upper and lower surface, said engaging members being disposed in at least partially overlapping relation to nest opposed vertical surfaces of a cubicle wall therebetween, said post having a lower end portion and being supported by one said engaging member, one said engaging member including at least one hole and two downwardly extending elongate spaced walls defining a channel, another said engaging member including an elongate slot, a base member having an upper portion having a cavity therein sized to accept said post to mount said post onto said base member, said lower portion of said base including a threaded cavity, a threaded bolt positionable upwardly through said elongate slot and said at least one hole and threadable into said threaded cavity of said base member for securing said engaging members together between said bolt and said base member.

* * * * *